United States Patent [19]

Hsieh et al.

[11] 4,398,924

[45] Aug. 16, 1983

[54] SULFUR OXIDE REDUCTION IN A COAL GASIFICATION PROCESS

[75] Inventors: C. Richard Hsieh, San Rafael; Paul T. Roberts, Alameda, both of Calif.

[73] Assignee: Chevron Research Company, San Francisco, Calif.

[21] Appl. No.: 327,009

[22] Filed: Dec. 3, 1981

[51] Int. Cl.[3] ..... C10J 3/46; C10J 3/54

[52] U.S. Cl. ..... 48/202; 423/244

[58] Field of Search ..... 48/202, 210; 423/563, 423/244 A

[56] References Cited

U.S. PATENT DOCUMENTS

| | | | |
|---|---|---|---|
| 3,970,434 | 7/1976 | Gasior et al. | 48/210 |
| 4,115,249 | 9/1978 | Blanton et al. | 423/563 |
| 4,157,245 | 6/1979 | Mitchell et al. | 48/202 |
| 4,233,276 | 11/1980 | D'Souza et al. | 423/563 |
| 4,302,218 | 11/1981 | Friedman | 48/202 |

*Primary Examiner*—Peter F. Kratz

*Attorney, Agent, or Firm*—D. A. Newell; S. R. LaPaglia; E. A. Schaal

[57] ABSTRACT

A method for reduction of sulfur oxides generated by a coal gasification process is disclosed wherein a regenerable sorbent absorbs the sulfur oxide in an oxidizing atmosphere and releases the sulfur oxides in the form of hydrogen sulfide in a reducing atmosphere.

8 Claims, 2 Drawing Figures

SULFUR OXIDE REDUCTION IN A COAL GASIFICATION PROCESS

BACKGROUND OF THE INVENTION

The present invention involves a method for the reduction of sulfur oxides in a coal gasification process.

In view of recent increases in the price of crude oil, researchers have been searching for alternative sources of energy and hydrocarbons. Much research has focused on recovering the hydrocarbons from hydrocarbon-containing solids such as shale, tar sand or coal by heating or pyrolysis to boil off or liquefy the hydrocarbons trapped in the solid or by reacting the solid with steam, for example, to convert components of solid carbonaceous material into more readily usable gaseous and liquid hydrocarbons. Other known processes involve combustion of the solid carbonaceous materials with an oxygen-containing gas to generate heat. Such processes conventionally employ a treatment zone, e.g., a reaction vessel, in which the solid is heated or reacted.

In a typical coal gasification process, coal is contacted with steam and an oxygen-containing gas to produce a gaseous product. The sulfur in the coal is emitted as hydrogen sulfide.

When air is used as the oxygen-containing gas, the gaseous product contains high levels of nitrogen, which reduces the BTU content of the gaseous product. Some processes have used pure oxygen instead of air, in order to avoid having nitrogen in the gaseous product. This does eliminate the nitrogen from the product but it requires a source of pure oxygen, some oxygen plants are almost as large as the coal gasification plant they are supplying. Thus, one was faced with the alternatives of either producing a gaseous product diluted with nitrogen or finding a source of pure oxygen for their process.

Another solution to the nitrogen dilution problem is disclosed in U.S. Pat. No. 4,157,245. In one embodiment of the invention disclosed in that patent, a solid heat-transfer material, such as sand, is introduced into an upper portion of a reaction vessel and coal is introduced into a lower portion of the vessel. The physical characteristics of the heat-transfer material and the coal differ such that a superficial velocity of a fluid flowing upwardly through the vessel is greater than the minimum fluidizing velocity of the heat-transfer material and the terminal velocity of the coal, but is less than the terminal velocity of the heat-transfer material. A substantially countercurrent vertical flow of the two solids is maintained in the vessel without substantial top-to-bottom backmixing by passing steam upwardly through the vessel at a rate sufficient to fluidize the heat-transfer material and entrain the coal whereby the heat-transfer material substantially flows downwardly in a fluidized state through the vessel and the coal substantially flows upwardly in an entrained state through the vessel. The steam reacts with the coal to form a hot char and a gaseous product, with some of the sulfur in the coal being emitted as hydrogen sulfide. The heat-transfer material acts as a source of heat for the reaction between the steam and the coal. Cooled heat-transfer material is removed from a lower end of the vessel and the hot char, the gaseous product and the hydrogen sulfide are removed from an upper end of the vessel. The gaseous product is then separated from the hot char and the hydrogen sulfide by regular separation techniques.

In one method, the heat-transfer material can be heated by introducing it into an upper portion of a combustion zone, introducing the hot char into a lower portion of the zone, and contacting the heat-transfer material with the hot char while maintaining substantially countercurrent plug flow of the two solids by passing air upwardly through the combustion zone at a rate sufficient to fluidize the heat-transfer material and entrain the char. The heat-transfer material substantially flows downwardly through the combustion zone in a fluidized state and is heated while the char substantially flows upwardly through the combustion zone in an entrained state and is combusted, with some of the sulfur in the char being released as sulfur oxides.

The process in U.S. Pat. No. 4,157,245 is based in part on the discovery that in the typical coal gasification process, there are two separate reactions occurring in the same vessel: (1) an endothermic reaction between the coal and steam which produces the gaseous product, and (2) an exothermic reaction between the coal and the oxygen-containing gas which produces the heat necessary for the first reaction. The process of U.S. Pat. No. 4,157,245 separates these two reactions in two separate vessels and transfers the heat generated by the second reaction to the site of the first reaction via a heat-transfer material.

A major advantage of this process is that air can be used as the oxidizing gas without causing the resulting gaseous product to be diluted with nitrogen. A disadvantage of this process is that sulfur-containing gases are coming out of two vessels.

In the typical process wherein coal is contacted with oxygen and steam in the same vessel, sulfur which is contained in the coal is emitted as hydrogen sulfide, which can be cleaned from the gaseous product stream by known technology. In the process disclosed by U.S. Pat. No. 4,157,245, hydrogen sulfide is produced in the first reaction vessel, where the coal is contacted with the steam, and sulfur oxides are formed in the combustion zone, where the char is combusted with air or oxygen, and is released with the flue gas. Since the sulfur oxides must be removed before the flue gas can be released, it would be advantageous to transfer the sulfur oxides in the combustion zone to the reaction zone and release it as hydrogen sulfide so that it could be cleaned up by the same process equipment that removes hydrogen sulfide from the gaseous product stream.

SUMMARY OF THE INVENTION

The present invention overcomes the deficiencies of the prior art by incorporating a regenerable sorbent into the heat-transfer material that transfers heat from the combustion zone to the reaction vessel. In the combustion zone, the regenerable sorbent absorbs sulfur oxides in an oxidizing atmosphere. The heat-transfer material and the regenerable sorbent containing the sulfur are transferred to the reaction vessel where the sorbent releases its sulfur in a reducing atmosphere. Both the heat-transfer material and the sorbent are recycled between the combustion zone and the reaction vessel.

Preferably, the regenerable sorbent is either limestone, dolomite, lime, calcium aluminate cement, calcium oxide, magnesium oxide, barium oxide or barium titanate. More preferably, the regenerable sorbent contains calcium.

Preferably, the operating temperature of both the combustion zone and the reaction vessel are in excess of 1600° F.

BRIEF DESCRIPTION OF THE DRAWINGS

In order to facilitate the understanding of this invention, reference will now be made to the appended drawings. The drawings should not be construed as limiting the invention but are exemplary only. In the drawings.

DESCRIPTION OF THE PREFERRED EMBODIMENTS

Figure 1:
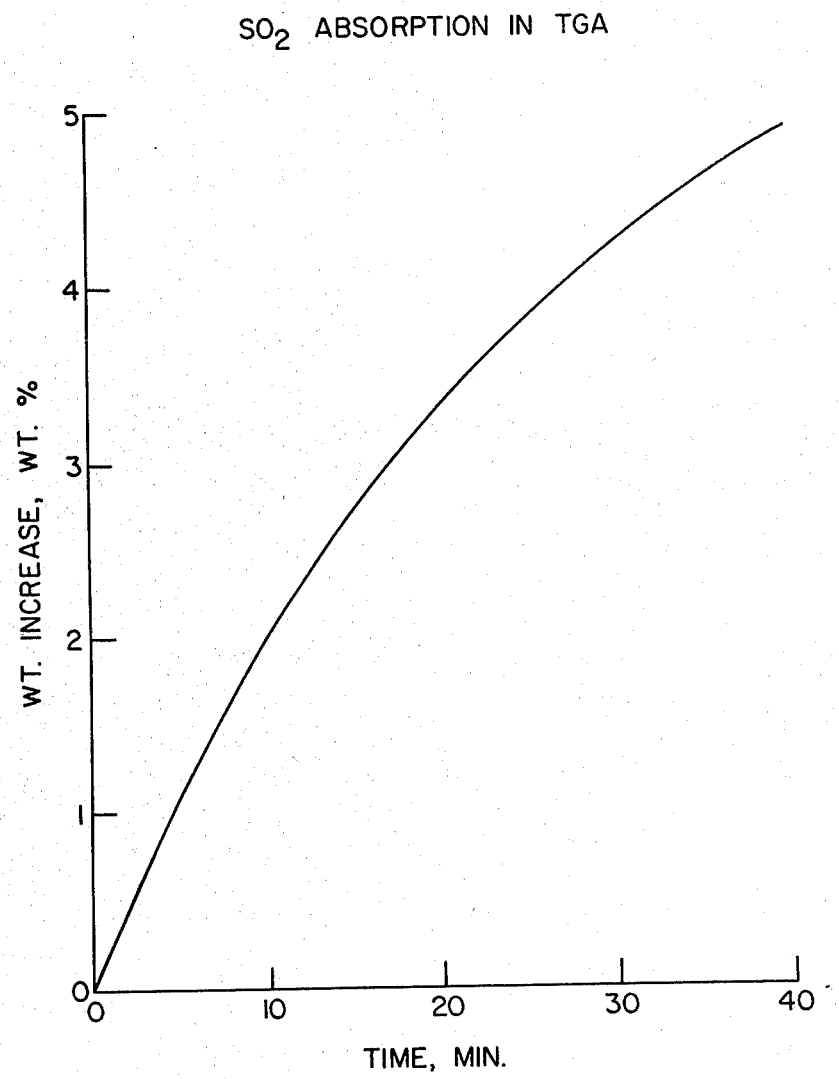
FIG. 1 shows the sulfur oxides absorption in a thermogravimetric analyzer for a sample containing 9% calcium oxide and the balance a char/sand mixture. The percent weight increase of the sample (a measure of how much sulfur oxides are absorbed) is plotted versus the length of time used to carry out the absorption.

In its broadest aspect, the present invention involves a method of transferring sulfur oxides from one vessel to another vessel and converting those sulfur oxides to hydrogen sulfide. It involves using a regenerable sorbent to absorb sulfur oxides in an oxidizing atmosphere, transferring the sorbent to another vessel, then releasing the sulfur oxides in the form of hydrogen sulfide in a reducing atmosphere.

The regenerable sorbent should have high activity, regenerability, and stability, as well as low cost. Examples of such sorbents would be limestones, dolomites, limes, calcium aluminate cements, calcium oxide, magnesium oxide, barium oxide, and barium titanate. The preferred sorbents are those containing calcium.

The present invention can be used in any coal gasification process having a reaction vessel and a separate combustion zone. In such a process, a coal containing sulfur is introduced into a reaction vessel where it is reacted with steam to form a hot char and a gaseous product, with hydrogen sulfide being released from the coal. The necessary heat for this reaction is supplied by a heat-transfer material which is subsequently removed from the vessel and introduced into a combustion zone. The hot char, the gaseous product and the hydrogen sulfide are removed from the vessel. The hot char is then separated from the gaseous product and the hydrogen sulfide, and is introduced into the combustion zone, where it is combusted with air to heat the heat-transfer material which is recycled to the reaction vessel. The combustion of the char releases sulfur oxides in the combustion zone.

Such processes include those described in U.S. Pat. No. 4,157,245. The present invention can be used in the processes disclosed in U.S. Pat. No. 4,157,245 incorporating a regenerable sorbent such as limestone into the heat-transfer material which is used to transfer the heat generated in the combustion zone to the reaction vessel where the gaseous product is produced. The regenerable sorbent is recycled between the combustion zone and the reaction vessel, with the sorbent absorbing sulfur oxides released from the coal in the combustion zone and releasing these absorbed sulfur oxides in the reaction vessel in the form of hydrogen sulfide. U.S. Pat. No. 4,157,245 is hereby incorporated by reference to disclose a coal gasification process which can be benefited by this process.

The regenerable sorbent can be incorporated into the heat-transfer material by any conventional method, such as blending, mixing, coating or impregnating the sorbent on the heat-transfer material.

In one particular embodiment of the present invention, limestone (a regenerable sorbent) is blended with sand (a solid heat-transfer material) so that the limestone represents about 5% to 10% of the weight of the blend.

In this embodiment, the sand/limestone blend is introduced into an upper portion of a vertically elongated reaction vessel which has a means for substantially impeding vertical backmixing of vertically moving solids in the vessel. Also introduced into an upper portion of the vessel is any sand/limestone blend that is recycled from the combustion zone. Coal is introduced into a lower portion of the vessel. The physical characteristics of the sand/limestone blend and the coal must differ such that a superficial velocity of a fluid flowing upwardly through the vessel is greater than the minimum fluidizing velocity of the sand/limestone blend and the terminal velocity of the coal, but is less than the terminal velocity of the sand/limestone blend.

Then steam is passed upwardly through the vessel at a rate sufficient to fluidize the sand/limestone blend and entrain the coal to maintain substantially counter-current flow of the sand/limestone blend and coal in the vessel without substantial top-to-bottom backmixing of the sand/limestone blend and the coal in the vessel. The sand/limestone blend substantially flows downwardly in a fluidized state through the vessel and any sulfur absorbed on the limestone (usually in the form of sulfate) is released in the form of hydrogen sulfide. The coal substantially flows upwardly in an entrained state through the vessel and the steam reacts with the coal to form a hot char and a gaseous product, with hydrogen sulfide also being released from the coal. The sand/limestone blend is removed from a lower end of the vessel at a temperature substantially lower than the temperature at which the blend was introduced into the vessel. The hot char, the gaseous product and the hydrogen sulfide are all removed from an upper end of the vessel, and the hot char is separated from the gaseous product and the hydrogen sulfide.

In the second part of this embodiment, at least a portion of the sand/limestone blend is introduced into an upper portion of a vertically elongated combustion zone having means for substantially impeding vertical backmixing of vertically moving solids substantially throughout the combustion zone. At least a portion of the hot char is introduced into a lower portion of the combustion zone. The sand/limestone blend is heated to an elevated temperature in the combustion zone by contacting the sand/limestone blend with the hot char while maintaining substantially countercurrent plug flow of the sand/limestone blend and the char by passing air upwardly through the combustion zone at a rate sufficient to fluidize the sand/limestone blend and entrain the char. The sand/limestone blend substantially flows downwardly through the combustion zone in a fluidized state and is heated to an elevated temperature while the char substantially flows upwardly through the combustion zone in an entrained state and is combusted. The combustion of the char releases any remaining sulfur in the form of sulfur oxides. These sulfur oxides are absorbed onto the limestone in the sand/limestone blend, and are transferred to the reaction vessel with the sand/limestone blend when at least a portion of the sand/limestone blend is recycled to the reaction vessel as a source of heat-transfer material.

The operating temperatures of both the combustion zone and the reaction vessel preferably should be in excess of 1600° F. If the operating temperature of the reaction vessel is below 1600° F., then the sulfates absorbed on the regenerable sorbent are too stable to reduce easily to hydrogen sulfide.

One of the advantages of the present invention is that there is no need for flue gas scrubbing or other additional apparatus to handle the sulfur oxides generated in the combustion zone. Instead, these sulfur oxides are absorbed on the regenerable sorbent that is incorporated in the heat-transfer material, are transferred to the reaction vessel with the heat-transfer material, and are released as hydrogen sulfide in the reaction vessel. Thus, the sulfur oxides released in the combustion zone can be treated by the same apparatus that treats the hydrogen sulfide released from the coal.

While the applicants do not wish to be bound by any one particular theory as to what causes their invention to work, it is presently thought that the following is one possible explanation as to what occurs in the present process:

(1) In the combustion zone, the sulfur in the hot char is released as sulfur oxides because the combustion zone is operated in an oxidizing atmosphere. The sulfur oxides are absorbed onto the regenerable sorbent in the form of sulfate. When calcium oxide is used as the regenerable sorbent, the reaction could be represented by the following formula:

$$CaO+SO_2+\tfrac{1}{2}O_2\rightarrow CaSO_4$$

(2) In the reaction vessel, the sulfur in the coal is released as hydrogen sulfide because the reaction vessel is operated in a reducing atmosphere. The sulfates that are absorbed on the regenerable sorbent are released in the form of hydrogen sulfide. The sulfates are reduced by either the hydrogen, carbon monoxide or other chemically reducing agents present in the reaction vessel. When calcium oxide is used as the regenerable sorbent, the reaction could be represented by the following formulas:

$$CaSO_4+4H_2\rightarrow CaO+3H_2O+H_2S$$

or $$CaSO_4+4CO+H_2O\rightarrow CaO+4CO_2+H_2S.$$

The overall reaction can be represented by the formulas:

$$SO_2+\tfrac{1}{2}O_2+4H_2\rightarrow 3H_2O+H_2S$$

or $$SO_2+\tfrac{1}{2}O_2+4CO+H_2O\rightarrow 4CO_2+H_2S.$$

None of the above formulas represent all that occurs chemically in the present invention, but they give a partial explanation of why the present invention works.

EXAMPLES

The invention will be further illustrated by the following examples which set forth particularly advantageous method and composition embodiments. While the examples are provided to illustrate the present invention, they are not intended to limit it.

A laboratory boat combustor was used to screen various materials for sulfur dioxide absorption potency. The boat contained a mixture of char and ground sand (char/sand ratio 1:10 to simulate the entrained coal gasification process combustion zone), and an appropriate sulfur dioxide absorbent. To make a run, approximately 5 g of the mixture was burned at 2000° F. for 20 minutes and the flue gas was scrubbed with a freshly prepared 3% $H_2O_2$ solution. The solution was titrated for sulfate and the apparent sulfur in the char was defined as the amount of sulfur detected in the solution. When a certain amount of an absorbent is mixed with the char/sand mixture, part of the sulfur oxides formed in the boat combustor will be reabsorbed by the absorbent resulting in a reduction of apparent sulfur in the char. This reduction may be viewed as a reduction of sulfur oxides emission in the combustor. The results are shown in the following table.

SULFUR ABSORPTION WITH VARIOUS ABSORBENTS

Boat Combustor: 0.5 g Husky char, 4.5 g ground Ottawa Sand, x g absorbent, 2000° F.

| | Apparent Sulfur, Wt % | | | | | |
|---|---|---|---|---|---|---|
| | x = 0 | 0.05 | 0.1 | 0.5 | 1.0 | 1.5 |
| Absorbent | | | | | | |
| None | 1.61, 1.68 | | | | | |
| $Al_2O_3$ | | 2.07 | 2.10 | 1.37, 1.50 | 0.59 | 0.65, 0.66 |
| Porous Alundum | | | | 2.25 | 2.23 | 2.15 |
| $TiO_2$ | | | | 2.19 | 2.24 | 2.13 |
| $Fe_2O_3$ | | | | 1.89 | 0.92 | — |
| $Cu_2O_3$ | | | | 1.82 | 1.81 | 1.66 |
| MgO | | | | 1.64 | 1.49 | 1.35 |
| $Na_2CO_3$ | | | | 1.27 | 0.26 | — |
| BaO | | | | 0.76 | 0.38 | 0.32 |
| $BaTiO_3$ | | | | 0.67 | 0.40 | 0.37 |
| CaO | | 1.04 | 0.44 | 0.07 | 0.12 | — |
| $CaTiO_3$ | | | | 2.10 | 1.94 | 2.22 |
| $(CaO)_3Al_2O_3$ | | | | 1.40 | 1.20 | 0.80 |
| Attacote | | | | 2.21 | — | — |
| Lonestar Cement | | | | 0.57 | 0.42 | 0.35 |
| Atlas Cement | | | | — | — | 2.00 |
| Treato, Powder | | | | 0.0 | 0.04 | 0.04 |
| Treato Calcined | | | | | | |
| At 1200° F. | | 1.90* | 0.77 | — | — | — |
| At 1400° F. | | | | 1.41 | — | — |
| At 1600° F. | | | | 1.28 | — | — |
| At 2000° F. | | | | 2.00 | — | — |
| Dolomite | | 1.69 | 1.00 | 0.09 | — | — |
| Texas Limestone | | | | 0.10 | — | — |
| Kaiser Limestone | | 1.76 | 1.45 | 0.15 | 0.11 | 0.13 |
| Commercial Minerals | | | | | | |
| Limestone | | 1.65 | 0.82 | 0.12 | 0.12 | 0.08 |

*0.01 g Treato.

Because of its excellent performance in the boat combustor, TGA experiments were run with the calcium oxide sample. FIG. 1 shows the sulfur dioxide absorption curve for a 9% calcium oxide sample.

Figure 2:
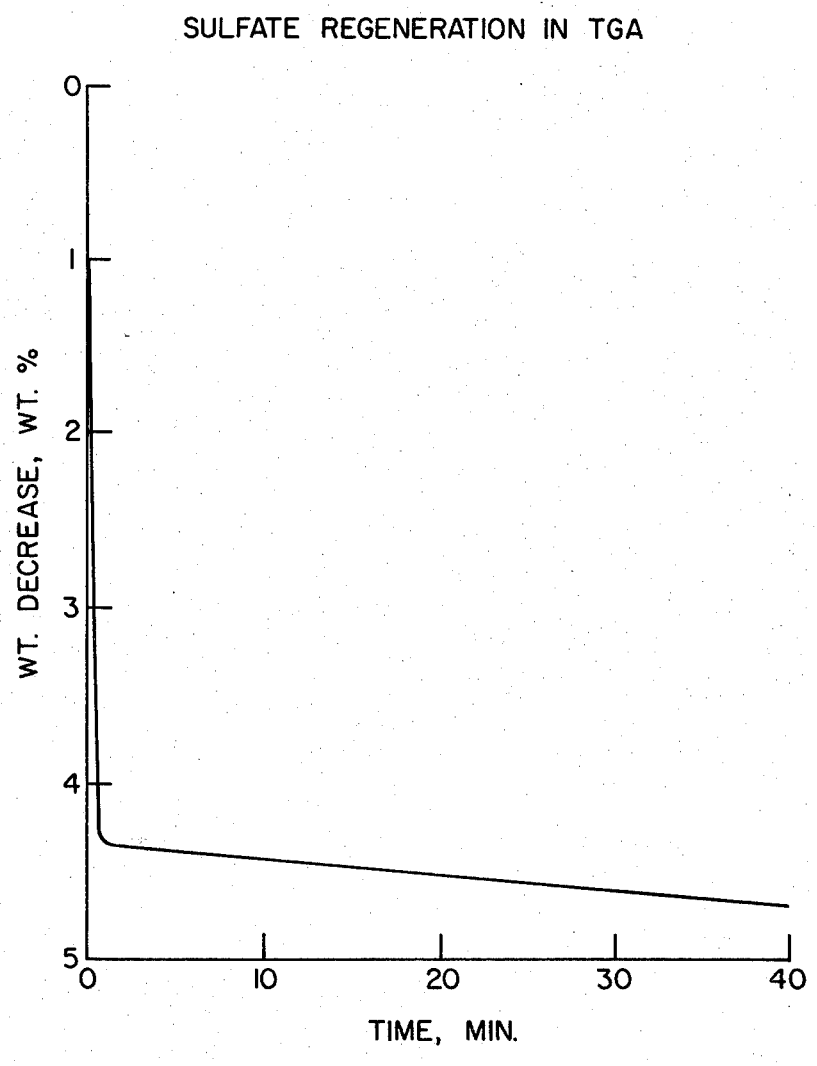
FIG. 2 shows the rate of sulfur regeneration for the same sample. The percent weight decrease of the sample (a measure of how much hydrogen sulfide is released) is plotted versus the length of time used to carry out the regeneration.

The regenerability and stability of calcium oxide were tested with TGA. The regeneration took place with 10% hydrogen in helium and the absorption with a mixture containing 2500 ppm $SO_2$, 2.5% $O_2$, 19% $CO_2$, and the balance $N_2$. Both the regeneration and the absorption took place at 2000° F. FIG. 2 shows the sulfate regeneration. Most of the regeneration took place in the very first minute. The same sample was regenerated three times-once right after the boat combustion, and twice after the TGA $SO_2$ absorption. In all three cases, the weight of the sample came down to exactly the same point, indicating "perfect" regeneration.

While the present invention has been described with reference to specific embodiments, this application is intended to cover those various changes and substitutions which may be made by those skilled in the art without departing from the spirit and scope of the appended claims.

We claim:

1. In the coal gasification process comprising:

(a) introducing a coal containing sulfur and a heat transfer material into a reaction vessel;

(b) passing steam through said vessel to react with said coal to form a hot char and a gaseous product, whereby hydrogen sulfide is released from the coal and wherein the heat necessary for said reaction is supplied by the heat-transfer material;

(c) removing the heat-transfer material from said vessel;

(d) introducing at least a portion of the heat-transfer material into a combustion zone;

(e) removing the hot char, the gaseous product and the hydrogen sulfide from the vessel, separating the hot char from the gaseous product and the hydrogen sulfide, and introducing at least a portion of the hot char into the combustion zone;

(f) heating the heat-transfer material to an elevated temperature in said combustion zone by combusting the char with air, thereby releasing sulfur oxides, and contacting the heat-transfer material with the combusted char; and (g) recycling at least a portion of said heat-transfer material to said reaction vessel as a source of heat-transfer material;

the improvement comprising a method of reducing said sulfur oxides comprising (1) absorbing onto a regenerable sorbent the sulfur oxides released in the combustion zone;

(2) transferring said regenerable sorbent to the reaction vessel;

(3) releasing the sulfur oxides from the regenerable sorbent in the reaction vessel in the form of hydrogen sulfide; and (4) recycling the regenerable sorbent to the combustion zone to absorb further sulfur oxides in step (2).

2. A method according to claim 1 wherein said regenerable sorbent is selected from the group consisting of limestone, dolomites, limes, calcium aluminate cements, calcium oxide, magnesium oxide, barium oxide and barium titanate.

3. A method according to claim 2 wherein said regenerable sorbent contains calcium.

4. A method according to claim 3 wherein the operating temperatures of both the combustion zone and the reaction vessel are in excess of 1600° F.

5. In the coal gasification process comprising:

(a) introducing a solid heat-transfer material into an upper portion of a vertically elongated reaction vessel, the vessel having a means for substantially impeding vertical backmixing of vertically moving solids in the vessel;

(b) introducing a coal containing sulfur into a lower portion of said vessel, the physical characteristics of the heat-transfer material and the coal differing such that a superficial velocity of a fluid flowing upwardly through the vessel is greater than the minimum fluidizing velocity of the heat-transfer material and the terminal velocity of the coal, but is less than the terminal velocity of the heat-transfer material;

(c) passing steam upwardly through said vessel at a rate sufficient to fluidize the heat-transfer material and entrain the coal to maintain substantially countercurrent vertical flow of the heat-transfer material and coal in the vessel without substantial top-to-bottom backmixing of the heat-transfer material and the coal in the vessel, whereby the heat-transfer material substantially flows downwardly in a fluidized state through the vessel and the coal substantially flows upwardly in an entrained state through the vessel, whereby the steam reacts with the coal to form a hot char and a gaseous product and whereby hydrogen sulfide is released from said coal;

(d) removing the heat-transfer material from a lower end of said vessel at a temperature substantially lower than the temperature at which the heat-transfer material was introduced into the vessel;

(e) introducing at least a portion of the heat-transfer material into an upper portion of a vertically elongated combustion zone having means for substantially impeding vertical backmixing of vertically moving solids substantially throughout the combustion zone;

(f) removing the hot char, the gaseous product and the hydrogen sulfide from an upper end of said vessel, separating the hot char from the gaseous product and the hydrogen sulfide, and introducing at least a portion of the hot char into a lower portion of the combustion zone;

(g) heating the heat-transfer material to an elevated temperature in said combustion zone by contacting the heat-transfer material with the hot char while maintaining substantially countercurrent plug flow of the heat-transfer material and the char by passing air upwardly through the combustion zone at a rate sufficient to fluidize the heat-transfer material and entrain the char, whereby the heat-transfer material substantially flows downwardly through the combustion zone in a fluidized state and is heated to an elevated temperature while the char substantially flows upwardly through the combustion zone in an entrained state and is combusted, thereby releasing sulfur oxides; and (h) recycling at least a portion of said heat-transfer material to said reaction vessel as a source of heat-transfer material;

the improvement comprising a method of reducing said sulfur oxides comprising:

(1) incorporating a regenerable sorbent into said heat-transfer material;

(2) absorbing onto the regenerable sorbent the sulfur oxides released in the combustion zone;

(3) transferring said regenerable sorbent with the heat-transfer material to the reaction vessel;

(4) releasing the sulfur oxides from the regenerable sorbent in the reaction vessel in the form of hydrogen sulfides; and (5) recycling the regenerable sorbent to the combustion zone to absorb further sulfur oxides in Step (2).

6. A method according to claim 5 wherein said regenerable sorbent is selected from the group consisting of limestone, dolomites, limes, calcium aluminate cements, calcium oxide, magnesium oxide, barium oxide and barium titanate.

7. A method according to claim 6 wherein said regenerable sorbent contains calcium.

8. A method according to claim 7 wherein the operating temperatures of both the combustion zone and the reaction vessel are in excess of 1600° F.

* * * * *